United States Patent [19]

Lochte

[11] Patent Number: 4,848,473

[45] Date of Patent: Jul. 18, 1989

[54] SUBSEA WELL CHOKE SYSTEM

[75] Inventor: Glen E. Lochte, Houston, Tex.

[73] Assignee: Chevron Research Company, San Francisco, Calif.

[21] Appl. No.: 135,783

[22] Filed: Dec. 21, 1987

[51] Int. Cl.[4] ..... E21B 34/04; E21B 43/01

[52] U.S. Cl. ..... 166/344; 166/91; 166/97; 166/365; 166/368

[58] Field of Search ..... 166/344, 365, 366, 368, 166/91, 97, 97.5, 85

[56] References Cited

U.S. PATENT DOCUMENTS

| | | | |
|---|---|---|---|
| 2,043,428 | 6/1936 | Cullen | 166/91 |
| 2,132,199 | 10/1938 | Yancey | 166/91 X |
| 2,943,640 | 7/1960 | James | 166/91 X |
| 3,097,695 | 7/1963 | Le Rouax et al. | 166/97.5 |
| 3,292,704 | 12/1966 | Miller | 166/91 |
| 3,357,491 | 12/1967 | Jones et al. | 166/368 X |
| 3,536,344 | 10/1970 | Nelson | 166/368 X |
| 3,545,541 | 12/1970 | De-Vries | 166/368 X |
| 3,595,311 | 7/1971 | Harbonn et al. | 166/368 |
| 4,007,380 | 2/1977 | Thurgood | 307/149 |
| 4,046,191 | 9/1977 | Neath | 166/0.5 |
| 4,210,208 | 7/1980 | Shanks | 166/352 |
| 4,503,878 | 3/1985 | Taylor | 137/315 |
| 4,535,967 | 8/1985 | Babbitt et al. | 251/54 |
| 4,589,493 | 5/1986 | Kelly et al. | 166/341 |
| 4,611,630 | 9/1986 | Muchow et al. | 137/625.37 |

*Primary Examiner*—Hoang C. Dang

*Attorney, Agent, or Firm*—S. R. La Paglia; E. J. Keeling

[57] ABSTRACT

A subsea well choke system is disclosed. The well choke system has annulus and tubing access as well as wing lines for connections to flow lines. A pressure control valve is installed in the tree cap for easy replacement and also to facilitate pigging and well test operations.

2 Claims, 3 Drawing Sheets

SUBSEA WELL CHOKE SYSTEM

BACKGROUND OF THE INVENTION

This invention is related to the field of offshore oil and gas production systems. In particular, the invention provides an improved choke system for subsea well completions.

In the field of offshore oil and gas production it is frequently desirable to use subsea well completions for oil and gas production operations. Such subsea well completions are particularly desirable in water where it would be uneconomical to install an offshore platform.

Several wells will generally be drilled in one area and the production from these wells will flow through a common subsea line to, for example, a central onshore processing plant or offshore platform. The pressure of fluids produced from various wells can vary significantly. Therefore, it is necessary to regulate the pressure which the higher pressure wells exert in the central flowline in order to permit lower pressure wells to flow. System which performs this function is known as a "choke" system. One such system is described in U.S. Pat. No. 4,589,493.

Prior art systems are generally configured as shown in FIG. 1. Such systems generally comprise a wellhead connector 1. Extending from the wellhead connector are a tubing connecting line 2 and an annulus connecting line 3. The tubing line has an upper end connected to a production lower master valve 4, whch is typically a gate valve and is used as a primary shutoff valve on the tubing string. Above and connected to the production lower master valve is the production upper master valve 5 which is used as a backup valve for shutting off the tubing. Above the upper master valve the tubing line divides. The upper portion is isolated by production swab valve 6 which is used for access to the well vertically in, for example, wireline operations.

Production wing line 7 is provided with a production wing valve 8, which can be used, for example, to isolate the well from the flowline 10 during well servicing operations. Downstream of the production wing valve, pressure control valve 9 is installed. Pressure control valve (PCV) 9, otherwise known as a choke, is used to regulate the downstream pressure of the flowing oil at an appropriate level for the flowline 10.

Annulus connecting line 3 is similarly provided with annular master valve 11, annular swab valve 12, and annular wing valve 13. Tree cap 14 is installed above the swab valves 6 and 12 to protect these lines from debris, sea growth, etc. Blind flanges 24, or the equivalent, are installed on the tree cap.

Such designs suffer several limitations, however. The pressure control (choke) valve in such installations is subjected to extreme wear and frequently requires replacement. This can be complicated, time consuming and costly in traditional well systems because the pressure control valve is integrated into the wellhead assembly. As a result, it is necessary to either remove the entire tree or have specialized tools for removal of the PCV. Further, if the PCV is adapted to be removed independently, it is necessary to install an additional block valve between PCV and the flowline so that the flowline may be isolated. Further, pigging of the flowlines and disposal of well test fluids can be complicated.

It is desirable, therefore, to devise an improved well choke system.

SUMMARY OF THE INVENTION

An improved apparatus for a subsea well completion is disclosed. The apparatus generally comprises a wellhead connector having tubing access and an annulus access; a tubing connection line having a first end at the tubing access and further comprising a tubing shutoff valve; an annulus connection line having a first end at the annulus access and further comprising an annulus shutoff valve; an annulus wing line connected to the annulus connecting line above the annulus shutoff valve and further comprising an annulus wing line shutoff valve; a tree cap tubularly connected to a second end of the tubing connection line and said annulus connection. The tree cap further comprises a production line riser connected at a first end to the tree cap at the tubing connection line; a pressure control valve connected to a second end of the production line riser; and a production return line connected at a first end to the pressure control valve and at a second end to the tree cap. A wing line is tubularly connected to the tree cap and the production return line and further comprises a tubing wing line shutoff valve.

DETAILED DESCRIPTION OF THE INVENTION

Figure 1:
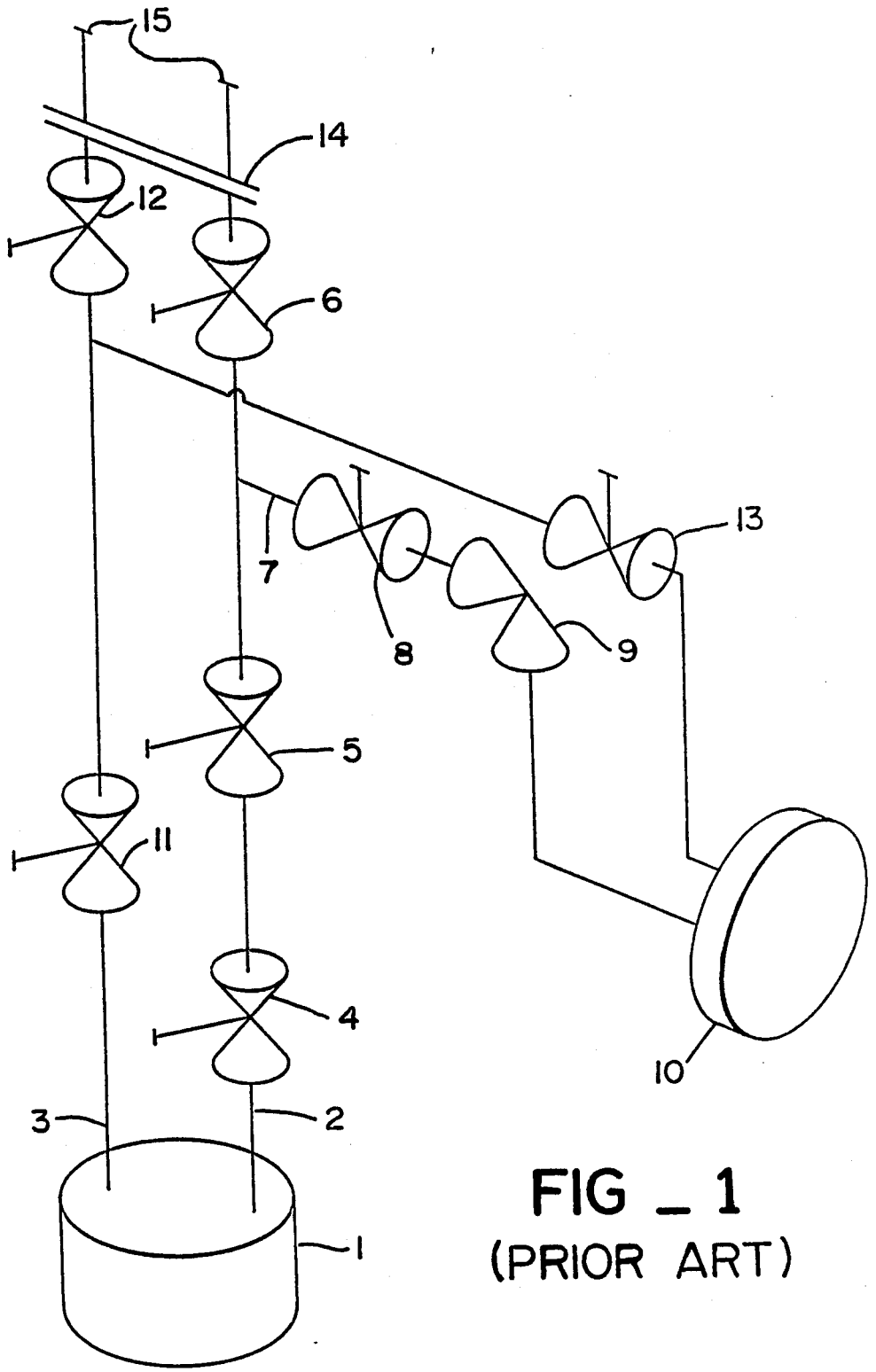
FIG 1 (PRIOR ART)
FIG. 1 shows a prior art well choke system in a schematic view.
Figure 2:
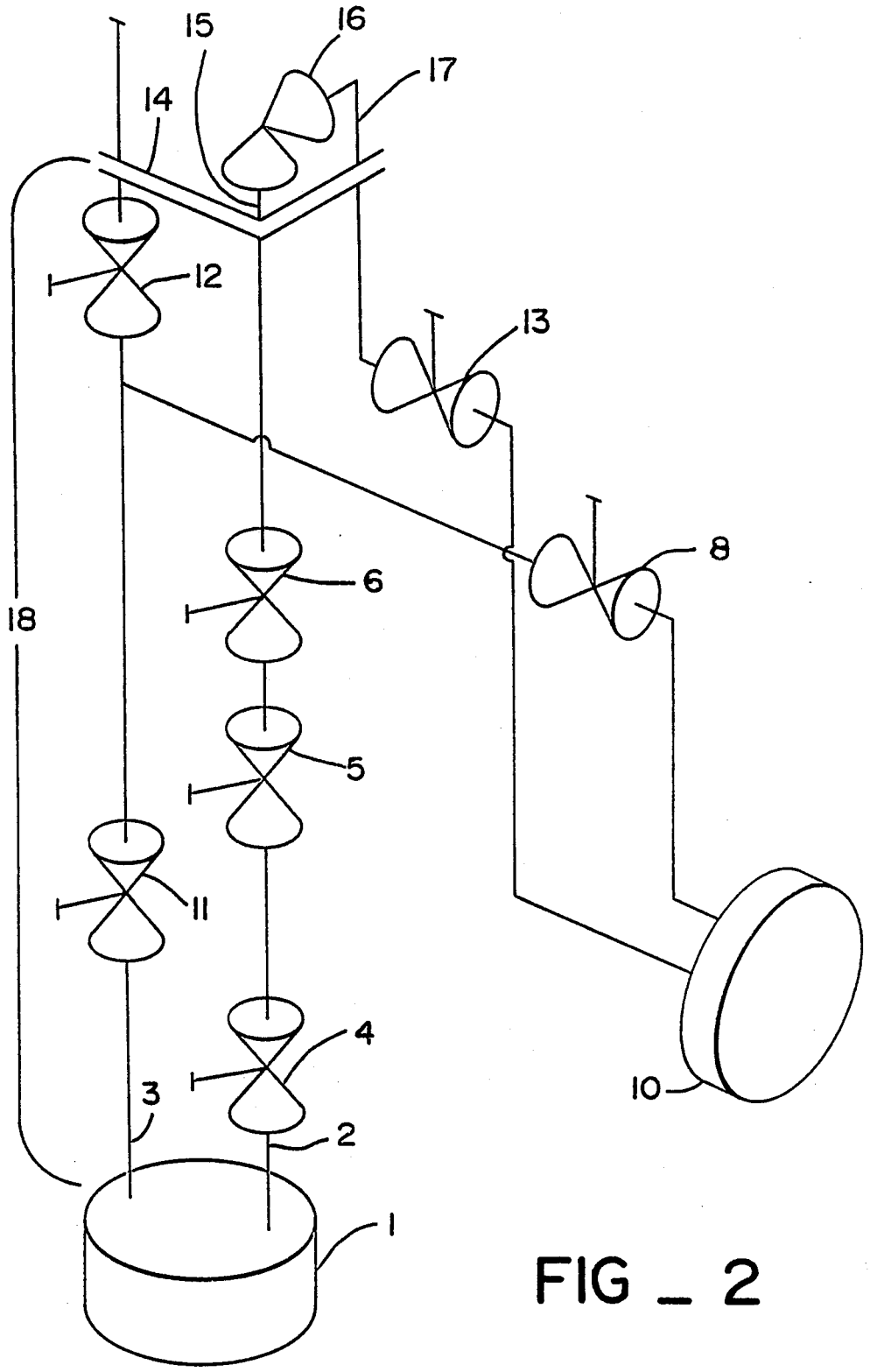
FIG. 2 is a schematic drawing of the well choke assembly described herein.

FIG. 2 illustrates schematically the invention described herein. As with the prior art well choke systems, wellhead connector 1 is provided with tubing connecting line 2 and an annulus connecting line 3. The production line is provided with a lower master valve 4, upper master valve 5, and production swab valve 6. The annulus connecting line 3 is provided an annulus master valve 11 and annulus swab valve 12. Wing valves 8 and 13 are installed on the production and annulus wing lines, respectively.

Instead of installing the pressure control valve in the production wing line, a riser 15 is installed on the tree cap 14. PCV 16 is installed on the riser, and return line 17 is used to direct production back into the tree from the tree cap.

Upon a review of FIG. 2, several advantages of this improved system become apparent. Most importantly, it becomes possible to service the high maintenance PCV readily since the tree cap may be routinely removed to perform wireline work in the well (e.g., twice per year). Since the PCV is in the same "package", its wearable parts may be conveniently replaced during a service operation which has been regularly scheduled. It is not necessary to remove the entire tree (designated generally by the reference numeral 18). Further, isolation of the production flowline during PCV servicing operations does not require the installation of an additional, and costly, block valve on the wing line.

Figure 3:
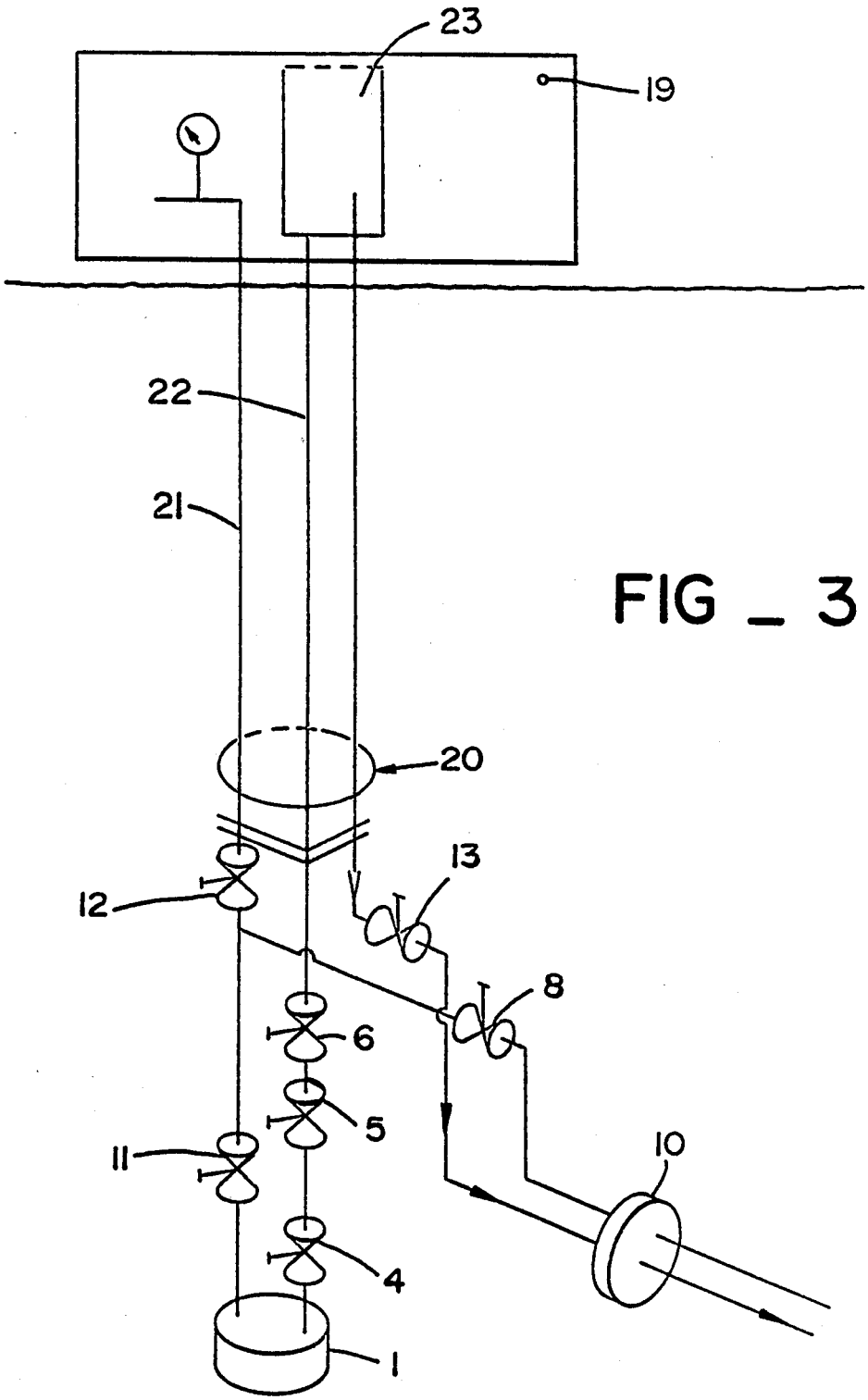
FIG. 3 schematically illustrates use of the equipment arrangement in a flowline pigging operation.

The above-described system has the further advantages of permitting pigging of the production flowline, as shown in FIG. 3. When a floating service vessel 19 is located generally above the wellhead. At least valves 4, 11, 5, 8, and 13 are closed. The tree cap 14 (with its PCV) is removed by the service vessel. Completion and workover riser 20 is installed and connects the tree 18 to the service vessel 19. Lines 21 and 22 monitor the annulus and tubing pressures respectively. A pig (not shown) is launched from pig launcher 23 on the service vessel 19, and proceeds downwardly through the riser and out the flowline through the wing valve 13. Such operations are not possible with prior art devices. Similarly, the design described herein facilitates access to the well for well test procedures by permitting return of well test fluids to the flowline through the workover riser after flowing through a test manifold on the service vessel.

It is to be understood that the above description is intended to be illustrative and not restrictive. The scope of the invention should, therefore, not be interpreted with response to the above description, but instead with reference to the appended claims along with the full range of equivalents thereto.

What is claimed is:

1. Apparatus for a subsea well completion comprising:

a. a wellhead connector having a tubing flow passageway in fluid communication with a well tubing and an annulus passageway in fluid communication with a well annulus;

b. a tubing connection conduit having a first end operatively connected to said wellhead connector and in fluid communication with said tubing flow passageway and further comprising a tubing shut-off valve;

c. an annulus connecting conduit having a first end operatively connected to said wellhead connector and in fluid communication with said annulus flow passageway; and further comprising an annulus shut-off valve;

d. an annulus wing conduit connected to said annulus connecting conduit above said annulus shut-off valve and further comprising an annulus wing conduit shut-off valve;

e. a treecap connected to a second end of said tubing connecting conduit and said annulus connection conduit, said treecap further comprising: (i) a production stream conduit connected at a first end to said treecap and said tubing connection conduit; (ii) a pressure control valve connected to a second end of said production steam conduit; (iii) a production return conduit connected at a first end to said pressure control valve and at a second end to said treecap; and f. a tubing wing conduit connected to said treecap and said production return conduit and further comprising a tubing wing conduit shut-off valve.

2. Apparatus as recited in claim 1 further comprising an annulus swab valve and a tubing swab valve in said annulus connection conduit and said tubing connection conduit respectively.

* * * * *